US006739312B2

(12) United States Patent
Komeda et al.

(10) Patent No.: US 6,739,312 B2
(45) Date of Patent: May 25, 2004

(54) THROTTLE DEVICE FOR ENGINE

(75) Inventors: Tetsuya Komeda, Kariya (JP); Kazunori Mori, Kariya (JP)

(73) Assignee: Denso Corporation, Aichi-Pref. (JP)

( * ) Notice: Subject to any disclaimer, the term of this patent is extended or adjusted under 35 U.S.C. 154(b) by 0 days.

(21) Appl. No.: 10/187,416

(22) Filed: Jul. 2, 2002

(65) Prior Publication Data

US 2003/0005910 A1 Jan. 9, 2003

(30) Foreign Application Priority Data

Jul. 5, 2001 (JP) ..... 2001-204293
Jun. 20, 2002 (JP) ..... 2002-179824

(51) Int. Cl.[7] ..... F02D 9/08
(52) U.S. Cl. ..... 123/337; 123/398; 123/339.23
(58) Field of Search ..... 123/337, 336, 123/339.23, 361, 367, 398, 399, 403

(56) References Cited

U.S. PATENT DOCUMENTS 5,304,336 A 4/1994 Karlsson et al. ..... 264/242
5,983,858 A 11/1999 Hashimoto et al. ..... 123/396
6,295,968 B2 * 10/2001 Torii et al. ..... 123/399
6,341,593 B2 * 1/2002 Kamimura et al. ..... 123/337
6,382,181 B2 * 5/2002 Wayama et al. ..... 123/399

FOREIGN PATENT DOCUMENTS

JP 10-047520 2/1998

* cited by examiner

*Primary Examiner*—Willis R. Wolfe
*Assistant Examiner*—Johnny H. Hoang
(74) *Attorney, Agent, or Firm*—Nixon & Vanderhye PC

(57) ABSTRACT

A throttle device for engine has a throttle valve, a shaft, and a valve gear. The valve gear is driven to rotate by a motor. The shaft and the valve gear are unitarily molded of a continuous resinous material. In the coupled area between the shaft and the valve, a recess section is provided. The recess section is formed, from the outer end face of the gear, coaxially with the shaft. The recess section serves as a thin-walled section, and prevents deformation of the gear likely to be caused by heat shrinkage. Furthermore, the recess section includes a through hole, which is effective for moving the ball bearing along the axial direction. A press-fitting tool is inserted into the through hole to install the ball bearing by pressing.

21 Claims, 7 Drawing Sheets

THROTTLE DEVICE FOR ENGINE

CROSS REFERENCE TO RELATED APPLICATION

This application is based on Japanese Patent Applications No. 2001-204293 filed on Jul. 5, 2001, and No. 2002-179824 filed on Jun. 20, 2002 the contents of which are incorporated herein by reference.

BACKGROUND OF THE INVENTION

1. Field of the Invention

This invention is related to a throttle device having a throttle valve.

2. Description of Related Art

In a conventional throttle device which transmits a motor torque to a shaft section of an engine throttle valve by the use of gears, the torque of a motor 101 is transmitted to a shaft 103 of a throttle valve 102 through a gear mechanism as shown in FIG. 5. For example, this type of throttle device has been disclosed by Japanese Patent Laid-Open Nos. Hei 10-89096 and Hei 10-47520. That is, the gear mechanism of such a motor-driven throttle device 100 is comprised of a gear 104 on the motor side mounted on the shaft of the motor 101, an intermediate reduction gear 105 in mesh with the gear 104 on the motor side, and a valve gear 106 mounted on one end portion of the shaft 103 of the throttle valve 102.

The valve gear 106 directly mounted on the shaft 103 of the throttle valve 102 is formed separately from the shaft 103. After fitting its central portion on one end portion of the shaft 103, the valve gear 106 is secured on one end portion of the shaft 103 by tightening a nut 111. The valve gear 106 is provided with an insertion hole 107 at the central section. The shaft 103 of the throttle valve 102 is inserted so that its both end portion will intersect with the intake air passages formed in the throttle body 108, and will be rotatably supported on ball bearings 109.

In the case of a throttle device 100, however, the torque of the motor 101 which has been reduced by the use of the gear 104 on the motor side, a large-diameter gear 112 and a small-diameter gear 113 of the intermediate reduction gear 105, and the valve gear 106, is transmitted to the shaft 103 of the throttle valve 102. However, the valve gear 106 is a component provided separately from the shaft 103, mounted by press-fitting on one end portion of the shaft 103, and furthermore fixed by tightening the nut 111. This type of mounting, therefore, raises such a problem that component count and manhour for installation will increase, resulting in an increased manufacturing cost.

There has been known a throttle device in which the throttle valve 102 and the metal shaft 103 are unitized for the purpose of reducing the component count and manufacturing cost as disclosed for example in Japanese Patent Laid-Open No. Hei 5-141540.

It is, therefore, considered to form the conventional metal shaft 103 and the metal valve gear 106 into a single body. FIGS. 6A, 6B, 7A and 7B show examples for comparison. There is also an idea to manufacture a geared shaft 120 by unitarily molding valve gear 121 and shaft 122 of a resin material. In the geared shaft 120, however, as shown in FIGS. 7A and 7B, the valve gear 121 is different in thickness between axial and radial directions. That is, the valve gear 121 has a non-uniform thickness or an asymmetrical shape. Because of the presence of the thick portion, non-uniform heat shrinkage after resin molding will occur. Consequently, the dimensional change and squareness of the tooth section of the valve gear 121 in relation to the shaft 122 will be deteriorated. In FIG. 7B, the broken line indicates a variation of the gear 121. Therefore it will become impossible to maintain proper engagement of the teeth of the valve gear 121 with the teeth of the intermediate reduction gear 105, possibly resulting in binding, cracking, or other defects of the tooth section of the valve gear 121.

SUMMARY OF THE INVENTION

One object of this invention is the provision of a throttle device in which a shaft and a lever for turning the shaft are formed as one body.

Another object of this invention is the provision of a throttle device designed to prevent lever deformation.

Another object of this invention is the provision of a throttle device designed to allow the mounting of a bearing which will be hidden by the lever.

Another object of this invention is the provision of a throttle device designed to allow the mounting of a magnetic sensor.

Another object of this invention is the provision of a throttle device in which the shaft and a gear as the lever are formed in one body.

Still another object of this invention is the provision of a throttle device which enables the reduction of component count and installation man-hours by the unitization of the shaft and the valve gear.

Further another object of this invention is the provision of a throttle device designed to insure proper engagement of the tooth section of the valve gear with the tooth section of the gear on the motor side.

According to one aspect of embodiments of this invention, the valve gear of the geared shaft meshes with the gear on the motor side to transmit the motor torque, thereby controlling the amount of opening of the engine throttle valve by the motor. The use of the geared shaft, in that the shaft and the valve gear are unitized, can decrease a screw fastening component and the number of man-hours. At the same time, a plurality of machining processes which require a high dimensional accuracy can be reduced. Consequently, it is possible to decrease component count, the number of machining processes and installation man-hours, to thereby enable the reduction of manufacturing cost.

The provision of a recess for nearly equalizing the thickness in axial and radial directions in the vicinity of the unitized portion of the valve gear shaft can make approximately uniform a molding shrinkage (called "shrinkage") caused by heat shrinkage of each part of the valve gear. Consequently, a dimensional change in the tooth portion of the valve gear can be controlled, to thereby prevent achieving a right angle and accordingly to maintain good engagement of the tooth portion of the valve gear with that of the gear on the motor side.

According to another aspect of the embodiment of this invention, there is provided a thin-walled section to reduce the weight of the geared shaft. That is, this invention has such an advantage as the reduction of weight and friction loss. As a result, it is possible to use a low-cost motor and to save materials.

According to another further aspect of the embodiment of this invention, through holes are provided at two places or more. Through the through holes, it is possible to insert a press-fitting tool for pressing and fixing an outer ring of a bearing section into the inner periphery of a bearing holding section of the throttle body. Therefore, bearings, such as thrust bearings, ball bearings, etc., can easily be installed in the throttle body by for example press-fitting and fixing. When a ball bearing is used as the bearing section, it is possible to press and fix the inner race on the outer periphery of the shaft and then the outer race into the throttle body. In this case, any play of the ball bearing can be prevented. Consequently, it is possible to prevent valve gear vibration, and accordingly to prevent a valve gear fracture, an increase in engaging torque, and an output deviation of a rotation angle sensor.

According to another further aspect of the embodiment of this invention, the geared shaft has a valve insertion hole unitarily formed, thereby enabling a reduction in the number of machining processes and in manufacturing cost.

According to still yet another further aspect of the embodiment of this invention, the shaft and the valve gear are formed as one body of a non-magnetic material such as aluminum, or stainless steel, etc. Thus it becomes possible to hold components of the rotation angle sensor without giving an adverse effect to the magnetic circuit of the non-contact type rotation angle sensor. The valve gear may be made in the form of, for example, a fan shaped gear. Furthermore, when the shaft and the valve gear are unitarily formed of a metal, the heat of the motor may be transmitted to the geared shaft through the valve gear. Consequently it is possible to use, for instance, a sintered metal which insures effective heat radiation from the motor.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
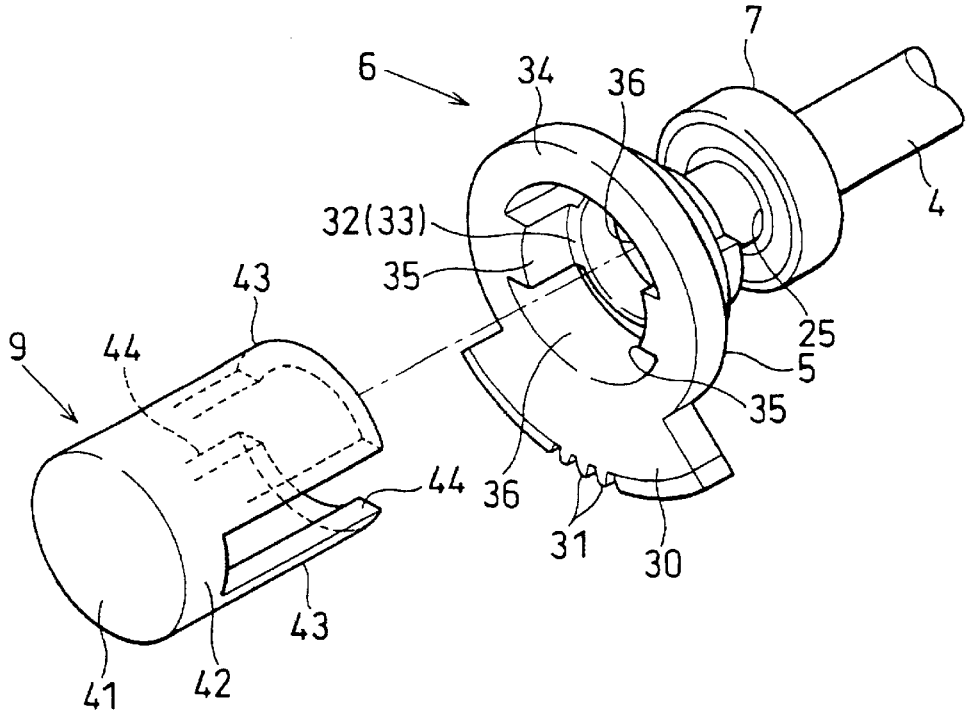
FIG. 1 is a perspective view of a geared shaft and a tool pertaining to the first embodiment of this invention.
Figure 2:
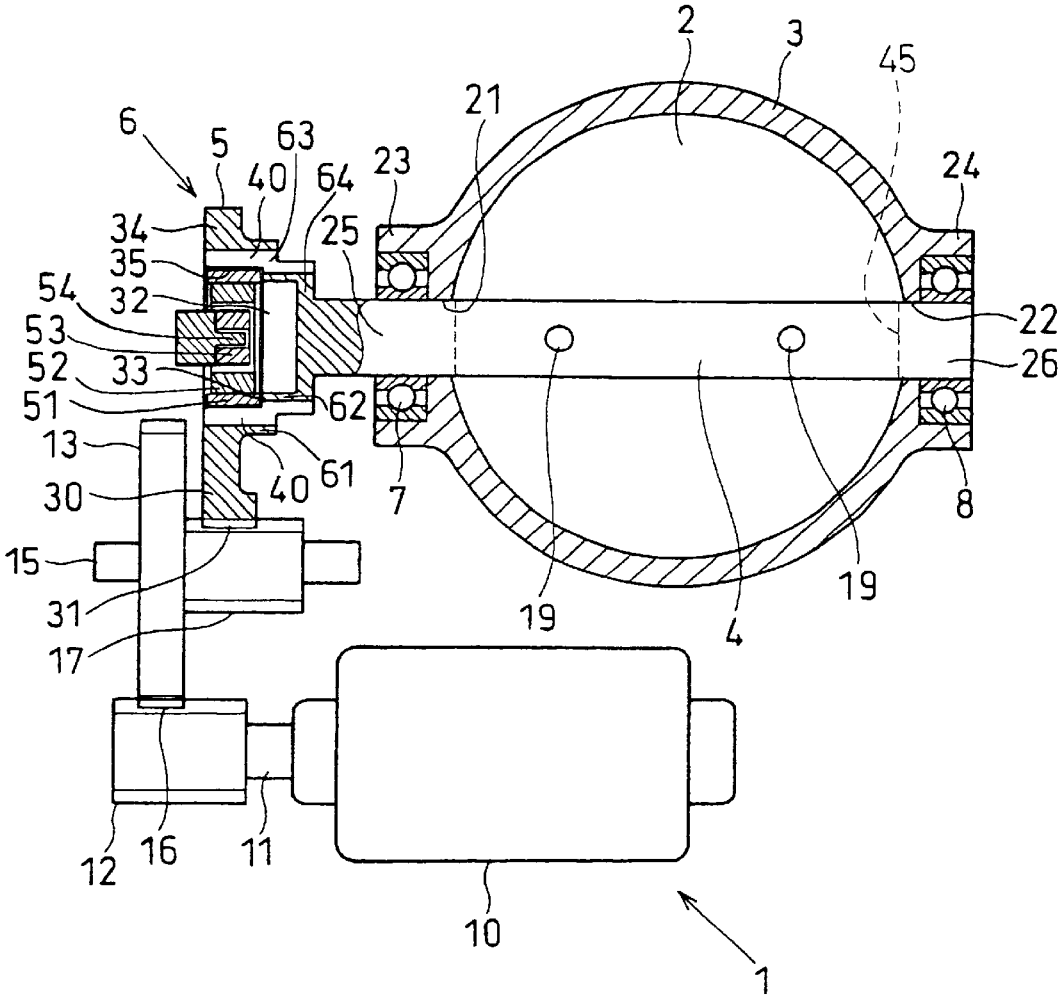
FIG. 2 is a sectional view of a throttle device for engine pertaining to the first embodiment of this invention.

A throttle device for an engine according to the first embodiment of this invention will be explained with reference to the accompanying drawings, in which FIG. 1 is a perspective view of a geared shaft. FIG. 1 shows also a tool for installing the ball bearing. FIG. 2 is a sectional view showing the throttle device for the engine.

The throttle device of the present embodiment has an electric actuator 1. A throttle control system is provided with an engine control unit (hereafter called ECU) for electronically controlling the actuator 1. The throttle device forms an intake passage communicating with the engine, and also has a throttle body 3 for rotatably holding the throttle valve 2 inside.

The throttle device is provided, on a shaft portion 4 of the throttle valve 2, with a geared shaft 6 which is formed unitary with a valve gear 5. The valve gear 5 has a larger diameter than the shaft portion 4. The valve gear 5 functions as a lever portion to be operated from outside. This valve gear 5 may be a grooved lever for wire connection. The unitary shaft 6 is produced of a resin which is a non-magnetic material. The geared shaft 6 is produced by molding a resin. The throttle body 3 has through holes 21 and 22 for inserting the shaft portion 4, and bearing holding sections 23 and 24. In the bearing holding section 23 is mounted a ball bearing (bearing section) 7 for rotatably supporting the illustrated left end portion (one end portion) of the geared shaft 6. In the bearing holding section 24, a ball bearing (bearing section) 8 is mounted for rotatably supporting the illustrated right end portion (the other end portion) of the geared shaft 6.

The throttle device adjusts the amount of intake air flowing into the engine, in accordance with the depth of depression of an accelerator pedal of the automobile, consequently adjusting the engine speed. The depth of depression of the accelerator pedal is detected by means of an accelerator opening sensor. The amount of opening (rotation angle) of the throttle valve 2 is detected by means of a non-contact type rotation angle sensor. Detection signals from the accelerator opening sensor and the rotation angle sensor are fed into the ECU. The rotation angle sensor is also called a throttle position sensor.

The rotation angle sensor is comprised of a rotor and a stator. In the present embodiment, the rotor has a yoke 51 produced of a magnetic material. In the yoke 51 is supported a permanent magnet 52 which maintains a magnetic field in a diametrical direction. The stator is secured on the throttle body or on a cover attached on the throttle body. The stator has a sensor IC 53 which includes a magnetic sensing element like a Hall element. The stator has a stator core 54 made of a magnetic material for flux collection in the sensor IC 53. The yoke 51 and the stator core 54 are produced of a ferrous metal. The rotation angle sensor is cylindrical on the whole, and is disposed inside the recess 35. The rotor is designed to rotate together with the valve gear 5. With the rotation of the rotor, the direction of magnetic flux passing the sensor IC 53 rotates. The sensor IC 53 produces an electric signal in accordance with the direction of the magnetic flux.

Consequently, a signal is obtained which corresponds to the amount of opening of the throttle valve. The yoke 51 may be a pair of semi-cylinders, which may be disposed respectively in the recess 36.

The actuator 1 has a motor 10 which is electronically controlled by the ECU. On the outer periphery of an output shaft 11 of the motor 10, a gear 12 on the motor side is secured. An intermediate reduction gear 13, rotating in mesh with the gear 12 on the motor side, is in mesh further with the valve gear 5. The motor 10, gears 12, 13 and 5 are supported on the throttle body 3. The gears 12, 13 and 5 are covered with a gear cover not shown. The motor 10 drives the geared shaft 6 through a gear train which comprises the gears 12, 13 and 5.

The gear 12 on the motor side turns as one body together with the output shaft 11 of the motor 10. The intermediate reduction gear 13 is unitarily formed of for example a resin. The intermediate reduction gear 13 is rotatably supported on the outer periphery of a support shaft 15. The intermediate reduction gear 13 has a large-diameter gear 16 and a small-diameter gear 17 which are unitarily formed in a stacked manner. The large-diameter gear 16 is in mesh with the gear 12 on the motor side. The small-diameter gear 17 is in mesh with the valve gear 5.

The support shaft 15 is fixed by pressing in a fitting hole formed in an unillustrated fixing member which is connected to the throttle body 3. A washer not shown is installed between the wall surface of the fixing member and the large-diameter gear 16. The actuator 1 is covered with an unillustrated actuator cover, which is fixed by fastening members such as bolts to the outside wall surface of the throttle body 3.

The throttle body 3 is an aluminum die casting, and is secured by tightening fasteners such as bolts to an engine intake manifold.

The throttle valve 2 is a butterfly-type rotary valve, which is installed and secured by welding or other to the shaft portion 4, and then fixed by the use of a fastening member 19 such as a pin.

The geared shaft 6 may be made of a sintered metal or aluminum. In this case, a sintering process or an aluminum die-casting process may be adopted to produce the geared shaft 6. The shaft portion 4 may be provided at the center with a slit 45 for valve insertion. In this case, the throttle valve 2 is inserted in the slit 45 and fixed by the use of a fastening member 19 such as a bolt.

The shaft portion 4 is provided at the illustrated left end (one end) with a bearing fitting section 25 where the inner race of the ball bearing 7 is fixed. At the illustrated right end (the other end), the shaft portion 4 is provided with a bearing fitting section 26 which contacts the inner race of the ball bearing 8.

The valve gear 5 has a radially projecting fan shaped portion 30 and a gear section (teeth section) which is formed in the shape of teeth on the outer peripheral surface of the fan shaped portion 30. The fan shaped portion 30 is projecting out over the outside wall surface of the throttle body 3 and rotates through a predetermined angle of rotation along the outside wall surface of the throttle body 3.

The valve gear 5 has a ring section 34 in addition to fan shaped portion 30. Between the ring section 34 and the shaft portion 4, coupling sections 61, 62, 63 and 64 are provided. The coupling section is formed in a shape of multiple-stage cylinders, having a plurality of radially extending areas and a plurality of axially extending areas. In the present embodiment, two internal projections 35, 35 form coupling sections. The coupling section defines a recess 32 extending in the axial direction of the shaft portion 4 from one end face of the valve gear 5. The coupling section is so formed as to gradually increase in outside diameter as it approaches the valve gear 5 along the axial direction. The coupling section is formed to a predetermined thickness. Inside of the coupling section, the recess is divided as a space. This recess 32 serves as a housing section for supporting the above-described sensor, and also functions as an area which allows access of a tool at the time of installation.

Adjacently to the unitized portion of the shaft portion 4 of the valve gear 5, that is, on one end face (illustrated left end face) of the valve gear 5, there is formed the recess 32. The recess 32 is formed nearly cylindrical in multiple stages, and is coaxial to the shaft portion 4. The recess 32 axially extends from the left end face of the valve gear 5. This recess 32 serves as a thin-walled section for reducing weight and material cost. On the inner periphery of the recess 32 is provided an annular step 33. Around the recess 32 is formed ring section 34. The projection 30 is provided on the outer periphery of a part of the ring section 34. The recess 32 has nearly equal thickness in the axial and radial directions of the ring section 34. The ring section 34 is not excessively non-uniform in thickness or not excessively asymmetrical in shape. The ring section 34 and the coupling section are not excessively increased in thickness by the provision of the recess 32, and besides can gain a substantial strength for transmitting the rotation of the valve gear 5 to the shaft portion 4.

On the inner periphery of the ring section 34 are formed a couple of projections 35, between which two internal recesses 36 are divided. On the illustrated right end face of the ring section 34, a middle ring 61 having a larger outside diameter than the shaft portion 4 is axially extended. The middle ring 61 has a less radial thickness than the ring section 34. The inner projections 35, 35 extend also into the middle ring 61. Further to the right side over the middle ring 61, that is, on the shaft portion 4 side, there is provided a small ring 62 which has smaller outside and inside diameters than the middle ring 61. The small ring 62 also has a less radial thickness than the ring section 34. Between the middle ring 61 and the small ring 62, there is provided a disk 63. Between the illustrated left end of the shaft portion 4 and the small ring 62, a disk 64 is provided.

Through holes 40, 40 are formed axially through the coupling sections 61, 62, 63 and 64. Each of the through holes 40 is formed nearly circular through from the left end face to the right end face of the ring section 34 shown. The through hole 40 is designed to allow axial insertion of a projection 43 of a press-fitting tool 9. The press-fitting tool 9 is used to press and fix the outer race of the ball bearing 7 into the inner periphery of the bearing holding section 23 of the throttle body 3. On the outer periphery of a circular base plate 41 of the press-fitting tool 9, a cylindrical side plate 42 is provided, axially projecting, as shown in FIG. 1. On the end in the axial direction of the side plate 42, another axially projection 43 is provided. Between these two projections 43 a couple of slits 44 are provided for fitting to the inner projection 35.

The two internal recesses 36 divided by the ring section 34 are approximately circular, axially communicating with the couple of through holes 40. The two through holes 40 are formed, in a direction parallel to the shaft portion 4, through a part of the outer peripheral portion (between the two internal projections 35) of the stepped recess section 32 of the valve gear 5, and in a direction (axial direction) also parallel to the direction of insertion of the two projections 43 of the press-fitting tool 9.

Next, operation of the throttle device will be briefly explained by referring to FIG. 2.

When the driver depresses the accelerator pedal, an electric signal is inputted from the accelerator opening sensor into the ECU. Then, the electric current is supplied to the motor 10 so that the throttle valve 2 may be opened to a predetermined amount of opening by the ECU, thus turning the output shaft 11 of the motor 10. With the rotation of the output shaft 11, the gear on the motor side 12 turns to transmit the torque of the motor 10 to the large-diameter gear 16 of the intermediate reduction gear 13. When the small-diameter gear 17 is turned with the rotation of the large-diameter gear 16, the valve gear 5 which is in mesh with the small-diameter gear 17 rotates, to thereby rotate the geared shaft 6 which is formed unitarily with the shaft portion 4. Therefore, the shaft portion 4 unitarily formed with the geared shaft 6 rotates through a predetermined angle of rotation; and in the engine intake air passage formed in the throttle body 3, the throttle valve 2 unitarily formed with the geared shaft 6 is held at a predetermined angle of rotation. On the other hand, the amount of opening of the throttle valve 2 is detected by means of the rotation angle sensor and inputted into the ECU. The ECU controls engine control parameters, such as the fuel injection quantity, etc., in accordance with an input signal.

By referring to FIGS. 1 to 3, the method of installation of the geared shaft 6 and the ball bearing 7 to the throttle body 3 in the present embodiment will be briefly explained. FIG. 3A is a plan view showing the valve gear. And FIGS. 3B, 3C, and 3D are partial sectional views showing installation procedures.

Figure 3A:
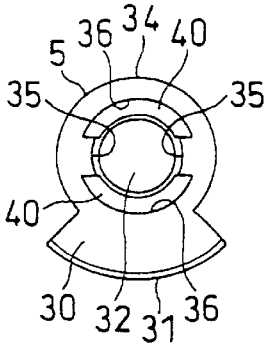
FIG. 3A is a plan view of a valve gear pertaining to the first embodiment of this invention.
Figure 3B:
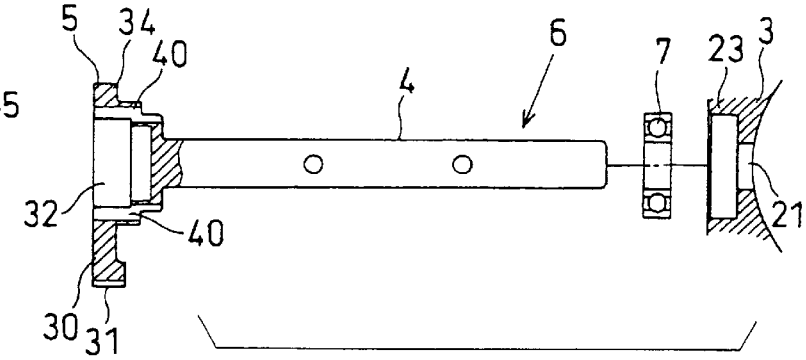
FIG. 3B is a partial sectional view showing the throttle device in an exploded state pertaining to the first embodiment of this invention.
Figure 3C:
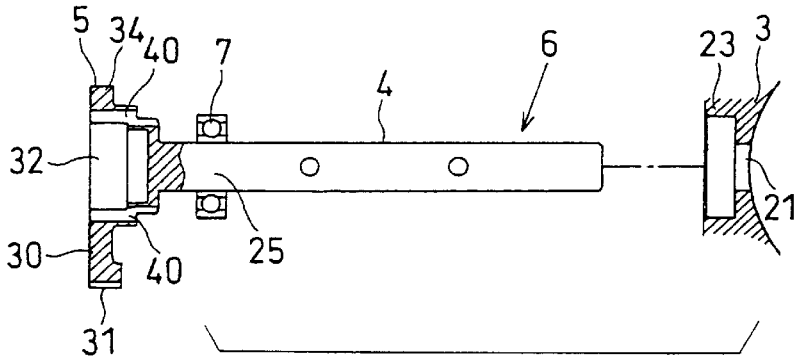
FIG. 3C is a partial sectional view showing the throttle device in an exploded state pertaining to the first embodiment of this invention.

First, as shown in FIG. 3C, the inner race of the ball bearing 7 is pressed onto the outer periphery of the shaft portion 4 and fixed in a predetermined position. Thus there is prepared an assembly with the ball bearing 7 pressed onto, and fixed on, the outer periphery of the bearing fitting section 25 of the shaft portion 4.

Figure 3D:
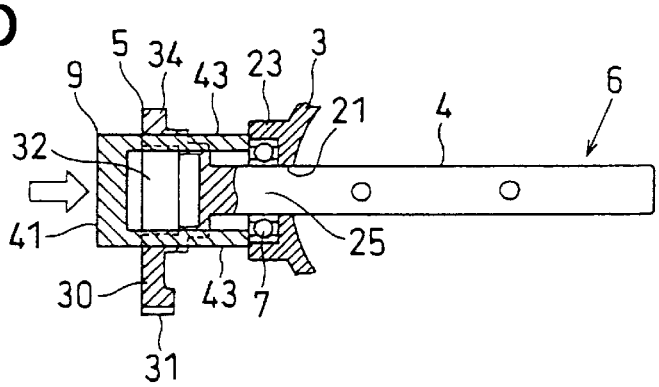
FIG. 3D is a partial sectional view showing a tool in use pertaining to the first embodiment of this invention.

Next, as shown in FIG. 3D, the shaft portion 4 is inserted into the through hole 21 of the throttle body 3. Thereafter, the projection 43 of the press-fitting tool 9 is inserted into the through hole 40. The projection 43 is nearly the same in diameter as the outer race of the ball bearing 7, and contacts the outer race. The outer race of the ball bearing 7 is pressed into and fixed in the inner periphery of the bearing holding section 23 by axially pressing the press-fitting tool 9. Thus the geared shaft 6 and the ball bearing 7 can easily be installed in the throttle body 3.

In the engine throttle device of the present embodiment, as described above, the shaft portion 4 and the valve gear 5 of the throttle valve 2 which are separate components in prior arts are unitarily molded. In the vicinity of the unitized section of the shaft portion 4 of the valve gear 5 there is provided the stepped recess 32 as a thin-walled section, thereby enabling approximately uniform shrinkage in each part of the valve gear 5 caused by heat shrinkage. It, therefore, is possible to control a dimensional change of the fan shaped portion 30 and the valve gear 5. In fabricating the geared shaft 6, therefore, the valve gear 5 is provided with a high-accuracy squareness to the axis of the shaft portion 4, consequently achieving proper engagement between the valve gear 5 and the small-diameter gear 17.

According to a conventional practice, it was necessary to press to fix the shaft 103 in the insertion hole 107 of the gear 106 or to fix by tightening a nut 111, a screw, or other. In the present embodiment, however, the geared shaft 6 requires no process for fixing the gear and the shaft. Furthermore, a machining process for gaining the dimensional accuracy of the shaft portion 4 can be dispensed with, thereby enabling the reduction of the component count, number of installation man-hours, and number of working man-hours. Therefore it is possible to decrease the manufacturing cost. The geared shaft 6 of the present embodiment has no thick portion for connection between the gear and the shaft. The coupling section is not required to have so high a strength as to withstand press-fitting and nut tightening. The coupling section may be designed to gain a strength required for torque transmission, consequently enabling reduction weight and material cost. Since a load torque to be applied to the motor 10 can be reduced, a low-cost motor 10 is usable.

In either of the conventional valve gear and shaft, fine tolerances are set with installation variations taken into account. In the present embodiment, however, these components are unitized, enabling the provision of wider tolerances. Conventionally, the joint and fitting area of the throttle valve and shaft demand dimensional accuracy, requiring a very large number of working man-hours. However, because the geared shaft 6 is adopted in the present embodiment, it is possible to mitigate the dimensional accuracy and to reduce the manufacturing cost.

Figure 5:
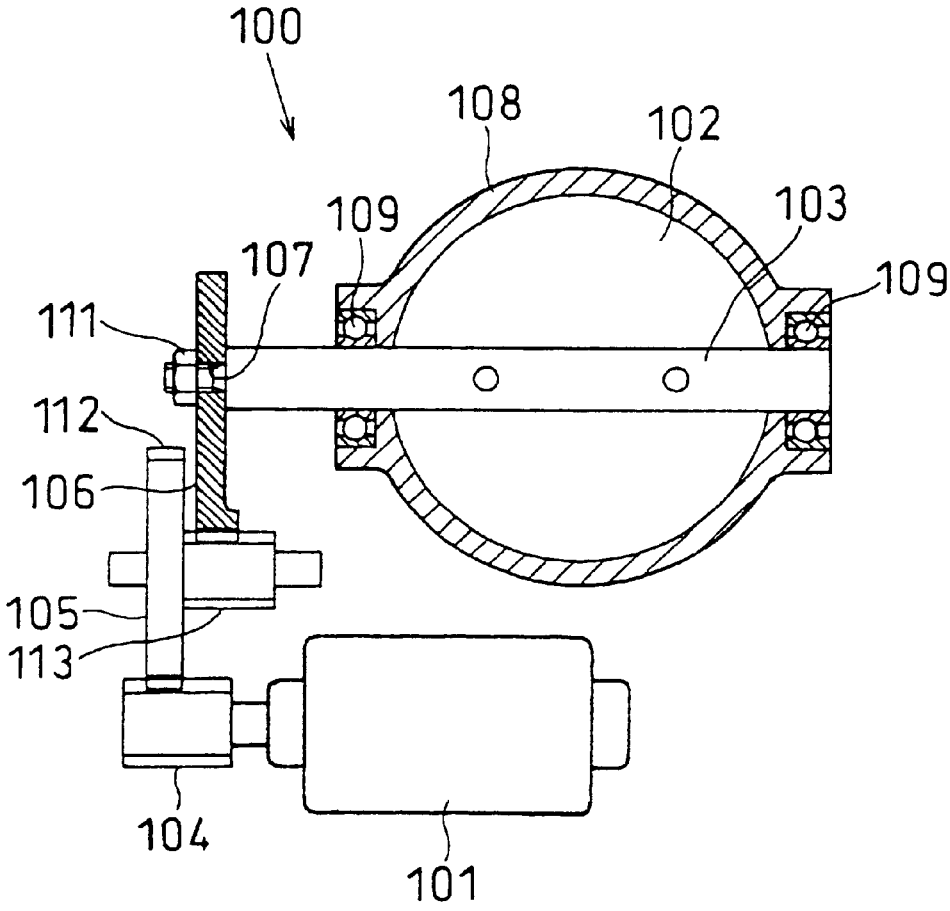
FIG. 5 is a sectional view showing a prior art throttle device.
Figure 6B:
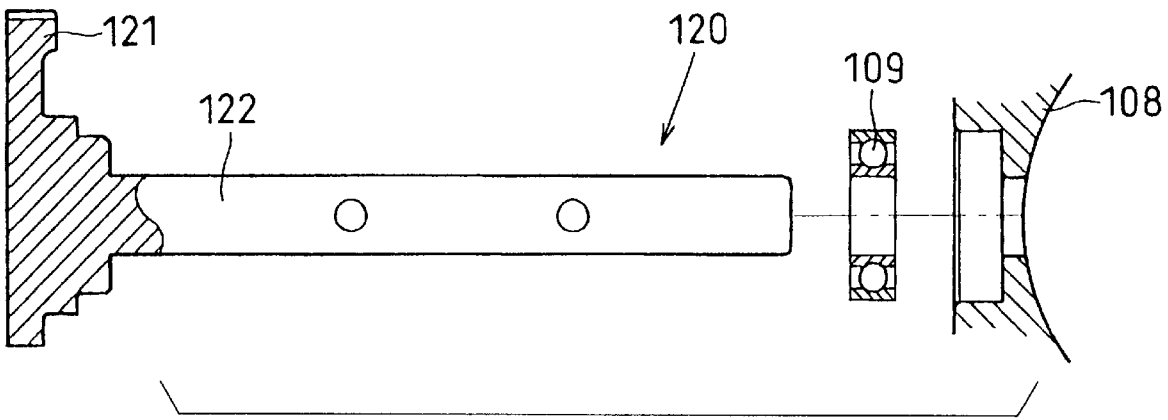
FIG. 6B is a partial sectional view showing the throttle device in an exploded state pertaining to a comparison example.
Figure 6A:
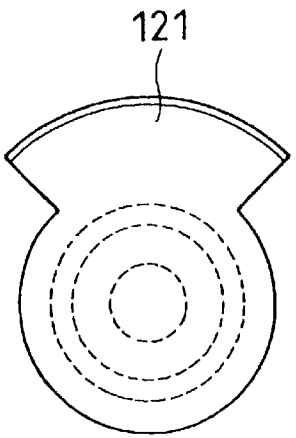
FIG. 6A is a plan view of the valve gear pertaining to a comparison example.
Figure 7B:
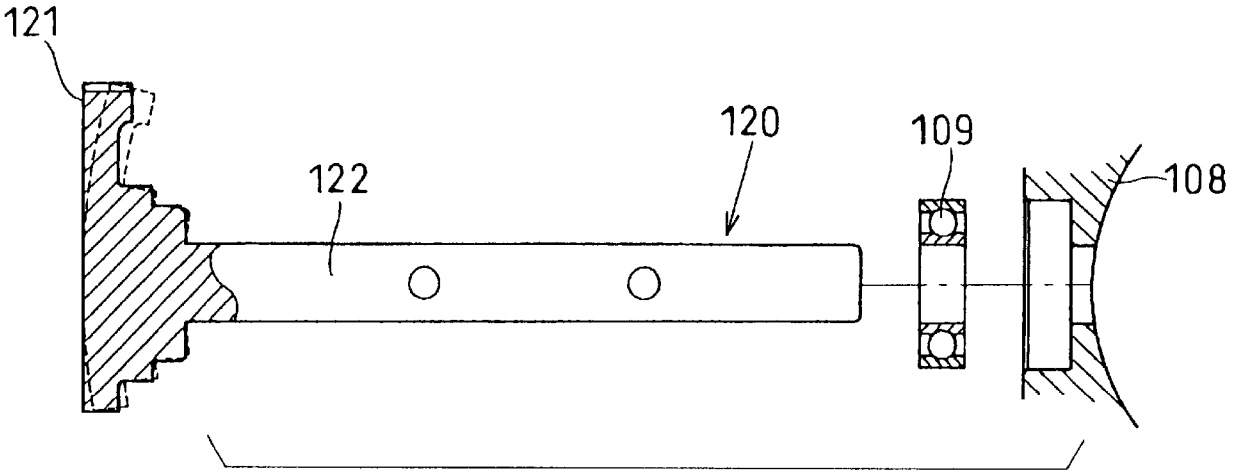
FIG. 7B is a partial sectional view showing the throttle valve in an exploded state pertaining to a comparison example.
Figure 7A:
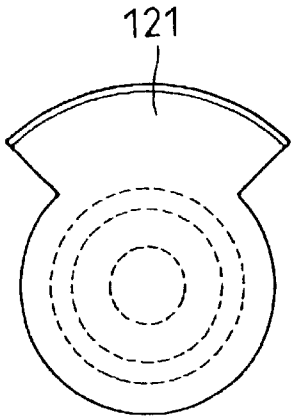
FIG. 7A is a plan view of the valve gear pertaining to a comparison example.

In the conventional structure shown in FIGS. 5, 6A and 6B, a defective gear engagement is likely to occur. For example, a play of the shaft 103 of the throttle valve 102, if present, will directly affect the engagement of the valve gear 106. As a result, there will arise such a problem as a damage to the valve gear 106 and an increased meshing torque of the valve gear 106. Furthermore, a play of the shaft 103 will induce an output error of the rotation angle sensor, resulting in deteriorated drivability such as idle speed hunting. Especially in the case of a contact-type rotation angle sensor, there will occur abnormal wear, and accordingly lowered durability, of resistors, brushes, etc.

For the first embodiment shown in FIGS. 1 to 3D, play, typically occurring in the shaft and gear components of the prior art, will not occur because of the unitization of the shaft and gear. Moreover, the gear axially covering the bearing is provided with the through hole 40, so that the bearing can be axially reached from outside of the gear 5, and reliably fixed. It is, therefore, possible to eliminate play in the ball bearing 7.

In the first embodiment, the contact-type rotation angle sensor may be used, to thereby enable prevention of an output error.

Figure 4B:
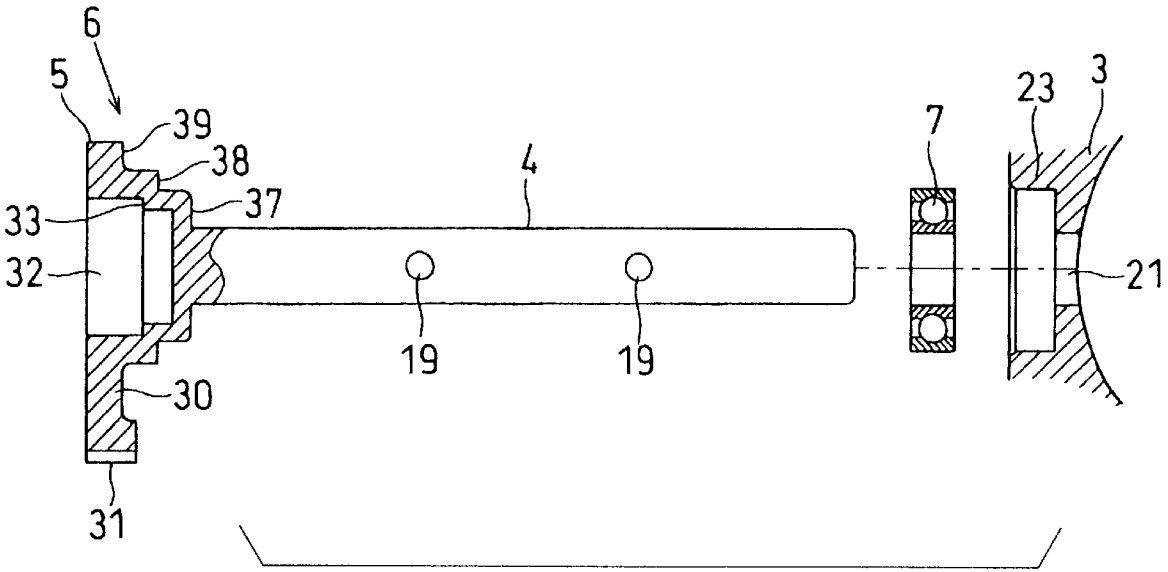
FIG. 4B is a partial sectional view showing the throttle device in an exploded state pertaining to the second embodiment of this invention.
Figure 4A:
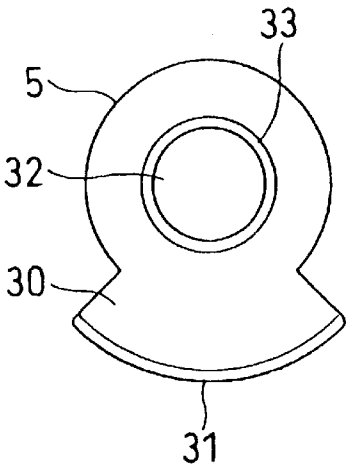
FIG. 4A is a plan view of the valve gear pertaining to the second embodiment of this invention.

FIGS. 4A and 4B show another embodiment. In this embodiment, the two through holes 40, two internal projections 35, and the internal recesses 36 are not provided. In the present embodiment, a press-fitting tool which differs in shape from the press-fitting tool 9 is used. As shown in FIG. 4B, the coupling section is formed in the shape of a multi-stage cylinder. This coupling section is comparatively thin and has a plurality of radially expanding ring-like faces 37, 38 and 39.

In addition to the valve gear 5 and the shaft portion 4, the throttle valve 2 also may be unitized. The inner race of the ball bearing 7 may be unitarily formed on the geared shaft 6 or the shaft having a valve gear. Furthermore, the inner race of the ball bearing 8 may be unitarily formed on the geared shaft 6 or the shaft having a valve gear. Also, the inner races of both ball bearings 7 and 8 may be unitarily formed on the shaft. The shaft portion 4 may be extended through inside the ring section 34. The recess 32 may be extended into the shaft portion 4. The shaft portion 4 may be formed large in diameter in the bearing fitting section 25.

The shaft and other may be produced of aluminum, resin, sintered metal, or non-magnetic material. The shaft and others may be produced by a metal sintering process, or a resin molding process, or an aluminum die-casting process. The use of sintered metal or aluminum allows easy transmission of heat of the motor 10 or other to the shaft portion 4. Consequently, heat evolved from such a heating section as the motor 10 or other which heats up when supplied with the electric current can be effectively radiated by the intake air flowing in the throttle body 3.

The geared shaft 6 may be produced of a stainless steel or such a non-magnetic material as aluminum, to thereby lessen an effect on a magnetic circuit of a magnetic sensor. In this case, a magnetic sensor component may be held directly on the geared shaft 6.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A throttle device for an engine, comprising:

a shaft supporting a throttle valve; and a lever provided on the end portion of the shaft and having a larger radius than the shaft, the shaft and the lever being unitarily formed of a common material, and a coupling section for connection between the shaft and the lever, defining a recess section extending from the end face of the lever.

2. The throttle device for an engine according to claim 1, wherein the lever has a ring section having a larger inside diameter than the shaft, and the coupling section extend radially outwardly from the shaft, reaching the ring section.

3. The throttle device for an engine according to claim 2, wherein the lever has a fan shaped section spreading radially outwardly from the ring section, and gear teeth are formed on the fan shaped section.

4. The throttle device for an engine according to claim 3, wherein the coupling section define the recess section radially inside of the lever.

5. The throttle device for an engine according to claim 4 wherein the recess section extends along the axial direction of the shaft from one end in the axial direction of the lever.

6. The throttle device for an engine according to claim 1, further comprising a bearing supporting the shaft, wherein the coupling section defines a through hole formed through in the axial direction, radially outside of the shaft, so that the bearing can be accessed from the end face of the lever through the through hole.

7. The throttle device for an engine according to claim 1, wherein the coupling section is on the axis of the shaft, defining a space radially inside of the lever.

8. The throttle device according to claim 1, wherein the shaft and the lever are formed coaxially with each other.

9. The throttle device according to claim 1, wherein the lever drives the shaft that supports the throttle valve.

10. A throttle device for an engine, comprising:

a shaft supporting a throttle valve; and a lever provided on the end portion of the shaft and having a larger radius than the shaft, said lever having a ring section having a larger inside diameter than the shaft, wherein the lever has a fan shaped section spreading radially outwardly from the ring section, with near teeth being formed on the fan shaped section, the shaft and the lever being unitarily formed of a continuous material, and a coupling section, for connection between the shaft and the lever, defining a recess section extending from the end face of the lever, said coupling section extending radially outwardly from the shaft reaching the ring section, wherein the coupling section defines the recess section radially inside of the lever and the recess section extends along the axial direction of the shaft from one end in the axial direction of the lever, and a magnetic sensor provided inside the recess section, said shaft and said lever being formed of a non-magnetic material.

11. A throttle device for an engine, comprising:

a shaft supporting a throttle valve; and a lever provided on the end portion of the shaft and having a larger radius than the shaft, said lever having a ring section having a larger inside diameter than the shaft, wherein the lever has a fan shaped section spreading radially outwardly from the ring section, with gear teeth being formed on the fan shaped section, the shaft and the lever being unitarily formed of a continuous material, and a coupling section, for connection between the shaft and the lever, defining a recess section extending from the end face of the lever, said coupling section extending radially outwardly from the shaft reaching the ring section, wherein the coupling section defines the recess section radially inside of the lever and the recess section extends along the axial direction of the shaft from one end in the axial direction of the lever, a magnetic sensor provided inside the recess section, said shaft and said lever being formed of a non-magnetic material, and a bearing supporting the shaft, wherein the coupling section defines a through hole formed through in the axial direction, radially outside of the shaft, so that the bearing can be accessed from the end face of the lever through the through hole.

12. A throttle device for an engine, comprising:

a shaft supporting a throttle valve; and a lever provided on the end portion of the shaft and having a larger radius than the shaft, the shaft and the lever being unitarily formed of a continuous material, a coupling section for connection between the shaft and the lever, defining a recess section extending from the end face of the lever, wherein the coupling section is on the axis of the shaft, defining a space radially inside of the lever, and a magnetic sensor located inside the recess section, wherein the shaft and the lever are formed of a non-magnetic material.

13. A throttle device for transmitting the torque of a motor to a throttle valve of an engine, comprising:

(a) a throttle body forming an intake air passage inside;

(b) a shaft portion rotatably supported in the throttle body and rotating unitarily with the throttle valve;

(c) a gear driven to rotate by the motor; and (d) a valve gear having a tooth section in mesh with the gear, and receiving the torque of the motor from the gear to rotate the shaft portion, wherein a geared shaft, in which the shaft portion and the valve gear are unitarily formed of a common material is provided, and the recess section for approximately equalizing thickness in the axial or radial direction is provided in the vicinity of the unitized portion between the valve gear and the shaft portion.

14. The throttle device for an engine according to claim 13, wherein the recess section serves also as a thin-walled section for reducing the weight of the geared shaft.

15. The throttle device for an engine according to claim 13, wherein an inner race pressed onto, and fixed on, the outer periphery of a bearing fitting section of the shaft portion and the bearing having an outer race which is pressed into, and fixed in, the inner periphery of a bearing holding section of the throttle body are integrally installed on the outer periphery of the geared shaft.

16. The throttle device for an engine according to claim 13, wherein, in the shaft portion, a slit for inserting to fix the throttle valve is provided, the geared shaft being unitarily formed in a shape having the slit by metal sintering process, resin molding process, or aluminum die-casting process.

17. The throttle device for an engine according to claim 13, wherein the valve gear is a fan shaped gear which is unitarily formed on one end area of the shaft portion, protruding out of the outer wall surface of the throttle body, and turns along the outer wall surface of the throttle body.

18. The throttle device according to claim 13, wherein the shaft portion and the valve gear are formed coaxially with each other.

19. A throttle device for transmitting the torque of a motor to a throttle valve of an engine, comprising:

(a) a throttle body forming an intake air passage inside;

(b) a shaft portion rotatably supported in the throttle body and rotating unitarily with the throttle valve;

(c) a gear driven to rotate by the motor; and (d) a valve gear having a tooth section in mesh with the gear, and receiving the torque of the motor from the gear to rotate the shaft portion, wherein a geared shaft, in which the shaft portion and the valve gear are unitarily formed are provided, and recess section for approximately equalizing thickness in the axial or radial direction is provided in the vicinity of the unitized portion between the valve gear and the shaft portion, wherein an inner race pressed onto, and fixed on, the outer periphery of a bearing fitting section of the shaft portion and the bearing having an outer race which is pressed into, and fixed in, the inner periphery of a bearing holding section of the throttle body are integrally installed on the outer periphery of the geared shaft, wherein, in a part of the inner periphery of the valve gear or in a part of the outer periphery of the recess section, through holes are provided at two places or more through which a press-fitting tool can be inserted to press-fit and fix the outer race of the bearing section in the inner periphery of the bearing holding section of the throttle body; the through holes at two places or more being formed, in parallel with the shaft portion, through a part of the inner periphery of the valve gear or a part of the outer periphery of the recess section.

20. A throttle device for transmitting the torque of a motor to a throttle valve of an engine, comprising:

(a) a throttle body forming an intake air passage inside;

(b) a shaft portion rotatably supported in the throttle body and rotating unitarily with the throttle valve;

(c) a gear driven to rotate by the motor;

(d) a valve gear having a tooth section in mesh with the gear, and receiving the torque of the motor from the gear to rotate the shaft portion, wherein a geared shaft, in which the shaft portion and the valve gear are unitarily formed are provided, and a recess section for approximately equalizing thickness in the axial or radial direction is provided in the vicinity of the unitized portion between the valve gear and the shaft portion, (e) a magnet which unitarily rotates with the geared shaft; and (f) a non-contact type rotation angle sensor disposed oppositely to the magnet, for detecting the amount of opening of the throttle valve by the use of the magnetic field received from the magnet.

21. A throttle device for transmitting the torque of a motor to a throttle valve of an engine, comprising:

(a) a throttle body forming an intake air passage inside;

(b) a shaft portion rotatably supported in the throttle body and rotating unitarily with the throttle valve;

(c) a gear driven to rotate by the motor;

(d) a valve gear having a tooth section in mesh with the gear, and receiving the torque of the motor from the gear to rotate the shaft portion, wherein a geared shaft, in which the shaft portion and the valve gear are unitarily formed are provided, and a recess section for approximately equalizing thickness in the axial or radial direction is provided in the vicinity of the unitized portion between the valve gear and the shaft portion, (e) a magnet which unitarily rotates with the geared shaft; and (f) a non-contact type rotation angle sensor disposed oppositely to the magnet, for detecting the amount of opening of the throttle valve by the use of the magnetic field received from the magnet, wherein the geared shaft is unitarily formed of a non-magnetic material.

* * * * *